US007706722B2

(12) United States Patent
Hildebrand et al.

(10) Patent No.: US 7,706,722 B2
(45) Date of Patent: Apr. 27, 2010

(54) METHOD AND APPARATUS FOR SHIFTING IMAGE FORMING APPARATUS PHOTORECEPTOR TO REDUCE GHOST FORMATION

(75) Inventors: Robert E. Hildebrand, Macedon, NY (US); Michael J. Martin, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 336 days.

(21) Appl. No.: 11/953,295

(22) Filed: Dec. 10, 2007

(65) Prior Publication Data

US 2009/0148183 A1 Jun. 11, 2009

(51) Int. Cl.
*G03G 15/00* (2006.01)

(52) U.S. Cl. ..... 399/162; 399/165

(58) Field of Classification Search ..... 399/159, 399/162, 165, 312, 313; 198/806, 807, 810.03, 198/813

See application file for complete search history.

(56) References Cited

U.S. PATENT DOCUMENTS

| | | | | |
|---|---|---|---|---|
| 5,659,405 | A | 8/1997 | Prevost et al. | |
| 6,038,423 | A * | 3/2000 | Tagawa et al. | 399/301 |
| 6,141,525 | A * | 10/2000 | Tahara | 399/395 |
| 6,253,047 | B1 | 6/2001 | Hildebrand et al. | |
| 6,385,419 | B1 * | 5/2002 | Genovese | 399/167 |
| 6,608,985 | B2 * | 8/2003 | Mochimaru et al. | 399/309 |
| 6,628,909 | B2 | 9/2003 | Monahan et al. | |
| 7,013,107 | B2 | 3/2006 | Russel et al. | |
| 7,039,348 | B2 | 5/2006 | Kerxhalli et al. | |
| 7,218,886 | B2 | 5/2007 | Hildebrand et al. | |

* cited by examiner

*Primary Examiner*—Hoan H Tran
(74) *Attorney, Agent, or Firm*—Oliff & Berridge, PLC

(57) ABSTRACT

A method and apparatus for shifting a photoreceptor in a cross-process direction to reduce the formation of a paper edge ghost on the photoreceptor. The shifting can occur continuously or in steps.

20 Claims, 3 Drawing Sheets

METHOD AND APPARATUS FOR SHIFTING IMAGE FORMING APPARATUS PHOTORECEPTOR TO REDUCE GHOST FORMATION

BACKGROUND

The present disclosure relates to reducing the formation of paper edge ghost in image forming apparatus that include photoreceptors.

A common issue with image forming apparatus using photoreceptors to produce images is the phenomenon called paper edge ghost. When an image forming apparatus, such as a photocopier, is used to produce a large number of images on one size paper over an extended period of time, and then, the same photocopier is used to produce images on a larger sized paper, a latent image can be seen in the image formed on larger sized paper. This artifact represents the edge of the previously-formed smaller sized paper. The paper edge ghost is visible in an image printed on the photoreceptor that traverses the areas previously covered by the smaller paper and the bare photoreceptor.

The effect of the paper edge ghost can be reduced by shifting the location of each image formed on the photoreceptor during the image forming process. However, when the image location is shifted, the position of the recording medium (for example, paper sheet) that receives the image from the photoreceptor also must be shifted so as to properly receive the image from the photoreceptor. Although it is possible to shift the image and the recording medium in the process direction (the direction in which the photoreceptor moves during image formation) relatively easily by controlling the timing of image formation and sheet feeding, it is more difficult to shift the image and recording medium in the cross-process direction (the direction crossing the process direction).

SUMMARY

Image forming apparatus and methods are disclosed that use a photoreceptor in the formation of images. To suppress the effects of paper edge ghost, the photoreceptor is shifted in the cross-process direction.

The photoreceptor may rotate in a process direction, that is orthogonal to the cross-process direction, during the image formation process. The photoreceptor is shifted in the cross-process direction with respect to a reference position such as, for example, a centered position of the photoreceptor. This shifting dithers the location of the photoreceptor with respect to the latent image, image charging units and image recording medium, which remain nearly stationary in the cross-process direction.

The shift amount is determined, for example, by a processing unit that receives position data corresponding to a sensed position of the photoreceptor. This position data is sensed by a sensor monitoring the position of the photoreceptor with respect to the reference position. The position data is compared to a target position, which varies relative to the reference position over time.

The result of the comparison is used to control a shifting mechanism that steers the photoreceptor in the cross-process direction. The target position can vary continuously or in steps.

The shifting motion suppresses the formation of paper edge ghosts on the photoreceptor in the cross-process direction.

EMBODIMENTS

Figure 1:
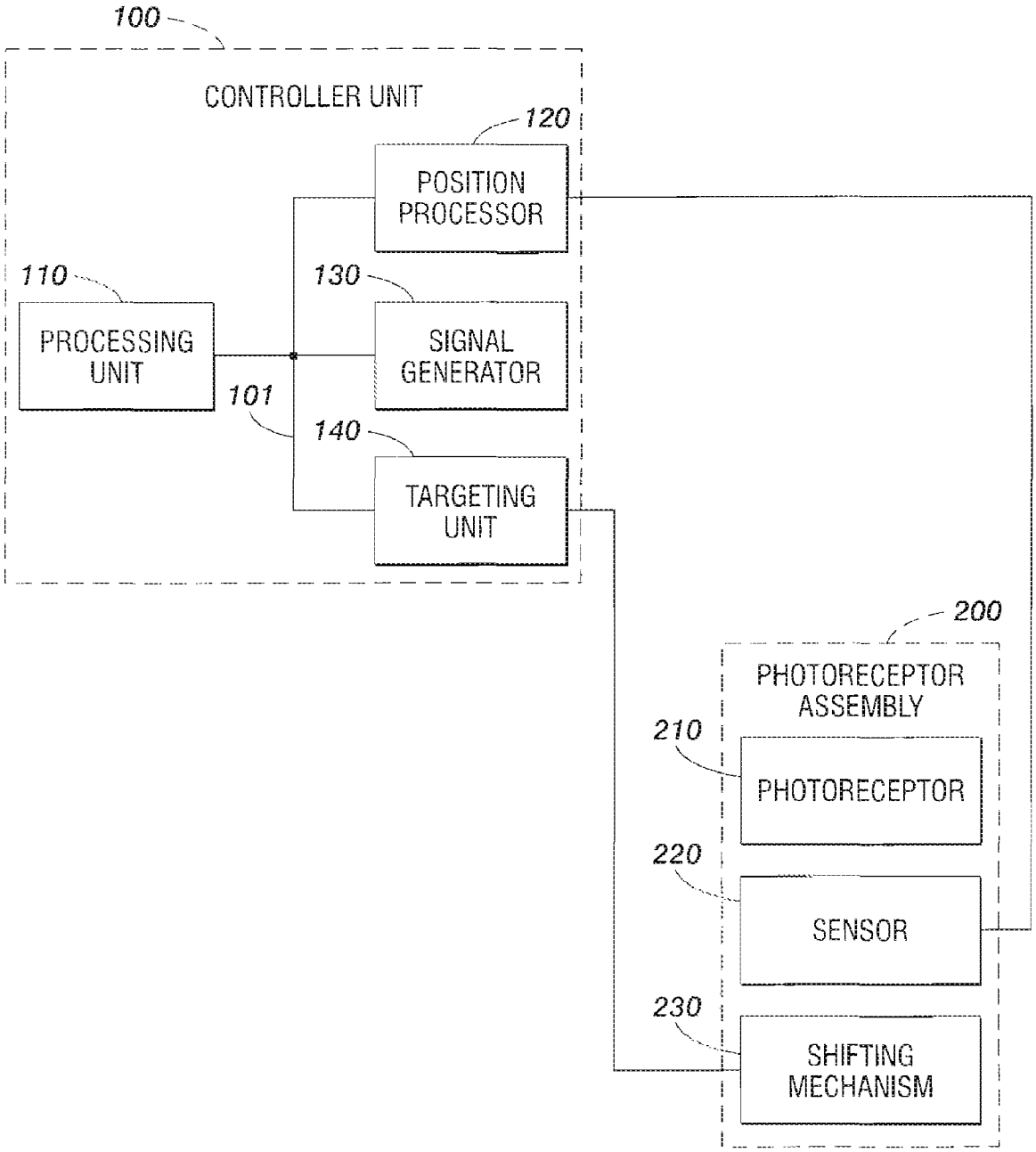
FIG. 1 is a block diagram of an apparatus described in the main embodiment.
Figure 2:
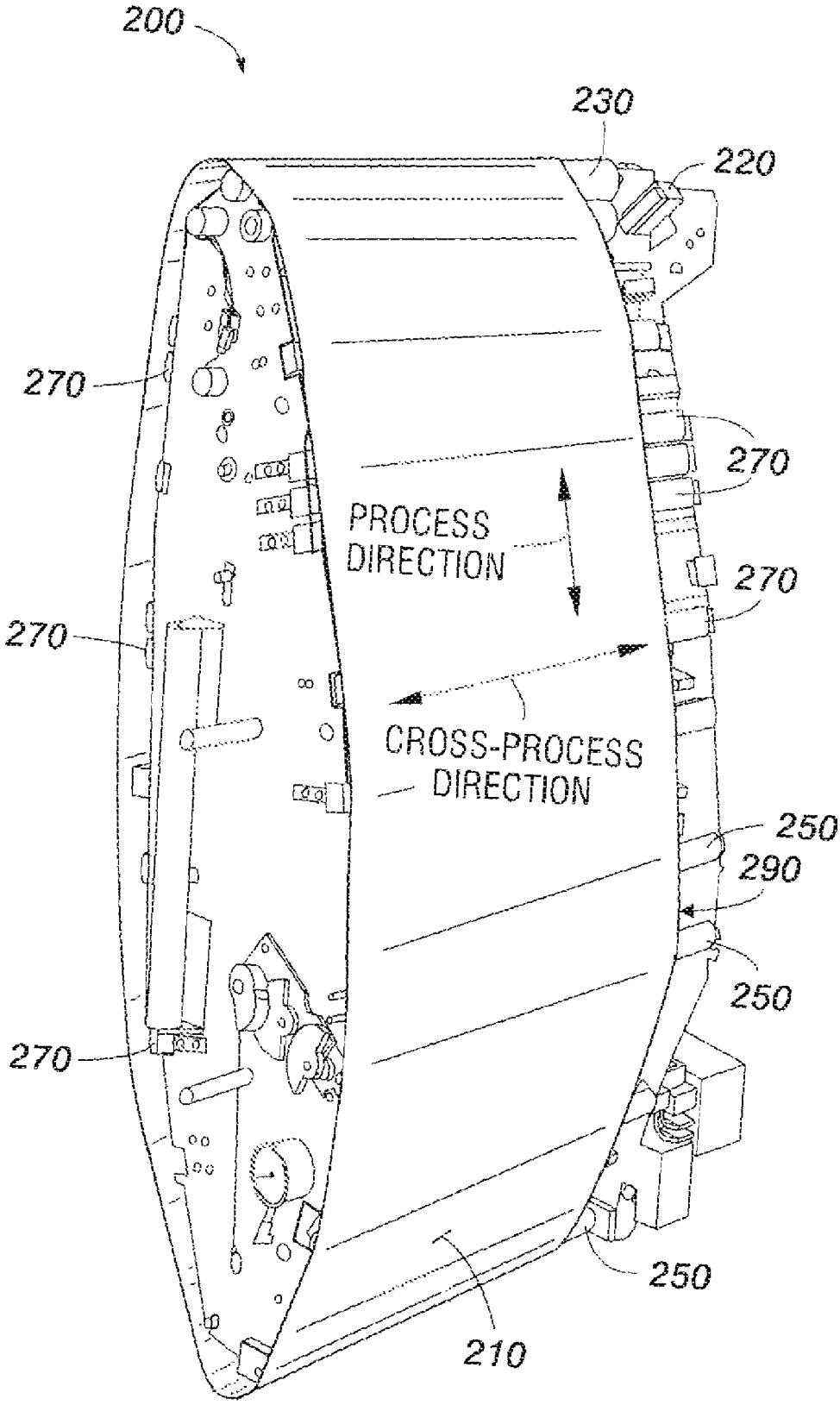
FIG. 2 is a view of a typical imaging photoreceptor assembly according to the present disclosure.

Referring to FIGS. 1 and 2, one embodiment of an apparatus capable of reducing paper edge ghost is described. This embodiment includes a photoreceptor assembly 200 that uses as a photoreceptor a continuous belt 210 having a photosensitive layer. The belt 210 is supported by guide wheels 250 and backer bars 270. Although this embodiment uses a belt photoreceptor, the disclosure also is applicable to all other photoreceptors that have the ghosting issue, including, for example, drum style photoreceptors. A sensor 220 is disposed to monitor the position of the belt 210. The belt 210 rotates along the guide wheels 250 in a process direction during image formation, as is known. Sensor 220 senses the position of belt 210 in a cross-process direction. Shifting mechanism 230 moves the belt 210 in the cross-process direction. A controller unit 100, which has a processing unit 110, position processing section 120, signal generator 130, and targeting unit 140 is provided. These sections of the controller unit 100 are linked together through communication bus 101. For a more detailed description of the photoreceptor assembly 200, including an edge sensor 220 and shifting mechanism 230, see U.S. Pat. No. 6,628,909 (Monahan et al.), the disclosure of which is incorporated herein by reference in its entirety.

In this embodiment, the photoreceptor assembly is assembled into a photocopier machine of the xerographic type. The photocopier in this example is a color photocopier that uses cyan, magenta, yellow and black (CMYK) toner to form color images on a recording medium such as paper. However, in other embodiments the image forming device can use any number of toners or other image-forming compositions. The photoreceptor's belt 210 rotates around the assembly, running on the guide wheels 250 in a process direction. Charging units (not shown) charge the belt 210. The charge on the belt 210 corresponds to components of (latent images of) the color image. One component exists for each of the four colors. The charged belt 210 receives toner for each latent image, and then transfers the toner images onto the paper recording medium (not shown). The four image components are superimposed on a single paper sheet. Thus, the color image is formed by the combination of the four color component images deposited onto the sheet of paper.

Sensor 220 senses the position of the photoreceptor in the cross-process direction. In this embodiment, the position of the inboard edge 290 of the belt 210 is sensed by maintaining a spring member in contact with edge 290 as described in the above-incorporated. U.S. Pat. No. 6,268,909. As the spring member moves in and out, the sensor outputs various voltage levels to the position processing section 120. In other embodiments, the sensor may be optical (for example, a charge-coupled-device) or of another mechanical type. Further the sensor does not necessarily need to sense the inboard edge, but may sense any other region or location of the photoreceptor.

The shifting, mechanism 230 is capable of shifting the belt 210 in the cross-process direction. An example of the cross-process direction in the current embodiment is shown in FIG. 2. One method of achieving the shifting mechanism is by using, a pivoting guide wheel as described in the above-incorporated U.S. Pat. No. 6,628,909. The pivoting guide wheel can maneuver the belt 210 to and fro in the cross-process direction.

The position processor 120 receives a signal corresponding to the sensed position from sensor 220, and processes the signal to determine the location of the belt 210 as compared to a reference location. In this embodiment, for example, the reference location is the inboard edge of the guide wheels, which is a fixed (constant) position. Position processor 120 communicates with processing unit 110 through communication bus 101.

The present disclosure differs from U.S. Pat. No. 6,628,909 as described below. U.S. Pat. No. 6,628,909 uses the output of an edge sensor to maintain the photoreceptor position fixed in the cross-process direction (for example, by comparing the sensed edge position with the fixed, reference position). The present disclosure compares the sensed position with a target position which varies relative to the fixed, reference position, in order to cause the photoreceptor to move in the cross-process direction over time, effectively "blurring" the edge of the "ghost image" so that the paper edge ghost is not perceptible when a larger image is formed after forming many smaller images. One technique for controlling the movement of the photoreceptor in the cross-process direction is described below.

Signal generator 130 generates a shifting signal. The shifting signal has a value that varies over time, and is used to generate a varying target position with respect to the reference position for the photoreceptor edge. Signal generator 130 does not need to be located within the controller unit 100, but instead may be a stand alone unit or, alternatively, disposed in a separate processing unit. The shifting signal in this embodiment is a sinusoidal signal whose amplitude corresponds to a movement amount by which the photoreceptor is to be moved in the cross-process direction relative to the reference position. The period of the signal is based on time, but also may be correlated to a specified number of copies, etc.

Processing unit 110 receives the position of belt 210 from the position processor 120 and the shifting signal from signal generator 130 through the communication bus 101. The processing unit uses this information, along with the reference position which is known, to determine a movement amount to achieve a target position. The movement amount is transmitted to the targeting unit 140 through communication bus 101.

Targeting unit 140 controls shifting mechanism 230, instructing the shifting mechanism 230 to shift the belt 210 inboard or outboard in the cross-process direction, in response to the movement amount received from processing unit 110. The belt 210 is shifted into the target position.

The paper edge ghost is formed by high volumes (usually in the order of thousands) of images formed for a single sized recording medium. In this example paper is the recording medium. Due to the image forming apparatus continuously processing the same sized images, the photoreceptor develops an outline of the image. This artifact is not apparent until the paper size is changed such that at least one dimension of the new image is larger than the previous image. In this situation, due to the outline of the previous, smaller image present on the photoreceptor, a perceivable latent image of the outline will form on the new, larger sized recording medium. This artifact is the paper edge ghost addressed by this disclosure.

The creation of a paper edge ghost can be reduced by shifting the location of the image with respect to the photoreceptor belt 210. In this embodiment the belt 210 is shifted in the cross-process direction with respect to the recording medium and the image-forming components to effectively "blur" the edge of the ghost image. The photoreceptor belt 210 is shifted inward and outward in the cross-process direction to, in effect, dither the relative location of the paper and image-forming components with respect to the photoreceptor belt 210. By increasing the area in which the edge of the image is formed on the photoreceptor, the paper edge ghost is blurred so as to be imperceptible to the human observer.

Figure 3:
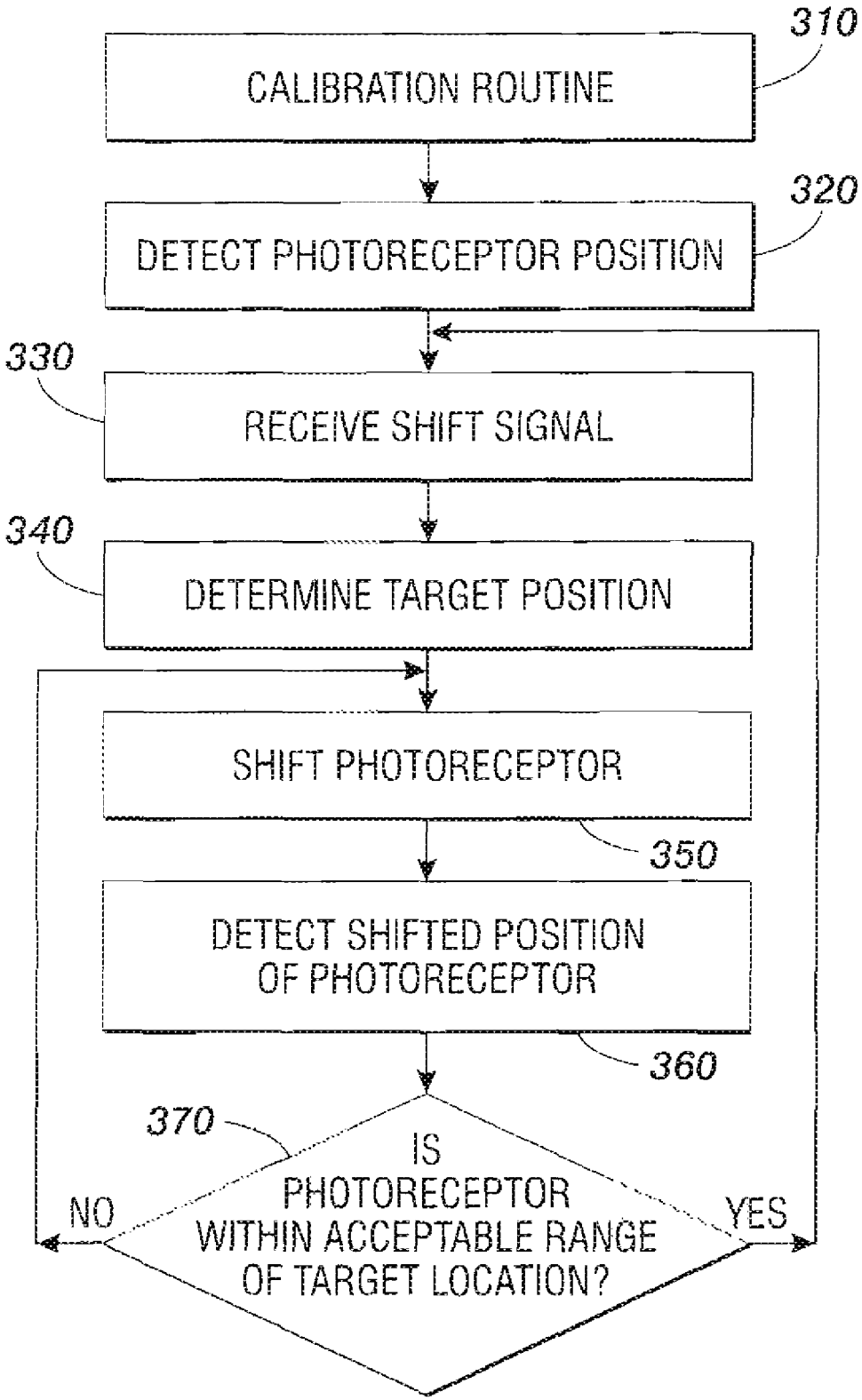
FIG. 3 is a flow chart outlining the process of the main embodiment.

FIG. 3 will be used as an outline to describe a method of reducing the effects of paper edge ghost using the above described apparatus.

Upon power up, the photocopier performs a calibration routine 310. Calibration routine 310 runs the belt 210 in the reference position. That is, the belt 210 is rotated in the process direction while it is fixed in the cross-process direction. In this embodiment, the reference position is the inboard edge of the guide wheels 250. Sensor 220 senses the edge of the belt 210 as the belt 2110 rotates in the process direction, while remaining stationary in the cross-process direction. Sensor 720 outputs the measured signal to position processor 120 of controller 100. The measured signal is recorded to memory (not shown) and is plotted to generate a profile of belt 210's edge. The plot of the belt's edge allows for the apparatus to compensate for imperfections and non-uniformities in the edge of the belt 210. That is, because the edge of belt 210 is not perfectly straight, the output of sensor 220 will vary even if the photoreceptor belt 210 remains fixed in the cross-process direction. However, the non-uniformity in the photoreceptor edge, and thus the variance in the signal output from edge sensor 220 can be correlated to the position of the photoreceptor in the process direction. Thus, by storing the plot of the belt's edge in memory, the system "learns" the shape of the signal that should be output by the edge sensor 220 as the photoreceptor is moved in the process direction while being maintained stationary in the cross-process direction. This "learned" shape can be considered to be the normalized reference position in that it represents a fixed, known position of the photoreceptor in the cross-process direction, while taking into account variations that will occur in the edge sensor output due to non-uniformities in the photoreceptor edge. The variations will be cyclical in that they will repeat with each complete rotation of the photoreceptor.

While the system of U.S. Pat. No. 6,628,909 would compare the sensed position of the photoreceptor edge with the above-described reference position, which is a varying signal that represents a fixed positions of the photoreceptor in the cross-process direction, the present disclosure superimposes a varying signal on the reference signal for comparison with the detected edge position.

In particular, in step 320, sensor 220 outputs the position of the belt. The processing unit 110 in step 330 receives the shifting signal that is generated by signal generator 130. In this embodiment, the shifting signal is a sinusoidal signal whose amplitude corresponds to a desired cross-process direction movement amount of the belt 210.

Processing unit 110 receives the shifting signal and superimposes it with the reference signal, as described above, to determine a target position for the belt in step 330. The target position thus will vary over time with respect to the reference position of the photoreceptor 210. In this embodiment, the reference position is, for example, the inboard edge of the guide wheels 250. In other embodiments, the reference position, may be the center of the photoreceptor assembly, or any other position that is stationary. The target position represented by the target signal indicates where the photoreceptor 210 is to shift to and fro along the cross-process direction, in effect dithering the location of the photoreceptor 210 with respect to the recording medium and the image-forming components of the image forming apparatus.

The target position information is sent to the targeting unit 140 in step 350 through communication bus 101. The targeting unit 140 controls the shifting mechanism 230 to steer the belt 210 to the target position. Sensor 220 continues to monitor the position of the photoreceptor, outputting the shifted position of the belt 210 in step 360. Position processor 120 receives sensor 220's output and processes the data to determine the current position of the photoreceptor 210.

The current position is communicated to the processing unit 110, and in step 370 a determination is made whether the photoreceptor 210 is within an acceptable range of the target position. If it is determined that belt 210 is in an acceptable position, the method returns to step 330 to repeat the process. The process may be repeated while the machine is on or only while in the process of image formation. If belt 210 is not yet in the correct position, the method returns to step 350 in which the processing unit 110 determines the distance the photoreceptor 210 must move and calculates the target position information to correct the position of the photoreceptor. Subsequently, targeting unit 140 controls the shifting mechanism 230 to steer the photoreceptor to the target position.

In this example, the shifting signal is a sinusoid over a period of time causing the photoreceptor 210 to shift continuously. Due to the nature of a photocopier or similar style image forming apparatus only a limited range of cross-process movement is allowable. This allowable range of motion must be accounted for when generating the shifting signal.

For example, when processing images with the image forming apparatus described above, each color image component for each color requires a certain amount of time to form. If the time to complete all four color components is, for example, 3 seconds, and the tolerance in the cross-process direction over the four color component images is, for example, 30 μm, then the photoreceptor 210 would be able to move in the cross-process direction at a rate of up to 10 μm/s while remaining within the tolerance. This tolerance will be called the image registration tolerance.

In this example, a shift in the location of the photoreceptor 210 with respect to the paper and image-forming components may cover a range of about 5 mm to effectively suppress the paper edge ghost artifact. In this example in which four color components are formed in 3 s while the photoreceptor 210 is moved in the cross-process direction at a rate of 10 μm/s, the photoreceptor will cover the 5 mm of cross-process direction movement in about 500 s or about 167 pages.

Paper edge ghosts tend to occur after a few thousand (about 5000 or more) images have been formed. Thus, it is possible to avoid ghosting while still obtaining acceptable image registration tolerance. Furthermore, it is possible to slow down the shifting mechanism to shift the photoreceptor 210 by 5 mm over the course of, for example, 4000 sheets, by shifting the photoreceptor 210 at a rate of about 0.42 μm/s. By slowing the shifting motion, the risk of exceeding the image registration tolerance is reduced.

In various other embodiments the shifting signal could be a square wave, a step-function, or any other function in which amplitude is changed over a period. Additionally, the signal may be a digital signal containing the information on where and when the photoreceptor should be shifted.

The process may shift the photoreceptor in steps rather than in the continuous motion described above. In an embodiment using the stepping approach, the photoreceptor may be moved in large steps occurring between image formation. For example, the image forming apparatus may shift the photoreceptor only between print jobs when the apparatus is not forming images. This method may present obstacles when print jobs exceed the number of image formations that tend to develop the paper edge ghost.

In the situation when the print job exceeds the number of image formations that tend to develop the paper edge ghost, the apparatus may interrupt the print job after a select number of images have been produced. During this interruption time, the photoreceptor may be shifted some distance. This method would be repeated throughout the print job to ensure the photoreceptor is dithered over an appropriate range to suppress the formation of the paper edge ghost.

It will be appreciated that the above-disclosed and other features and functions, or alternatives thereof, may be desirably combined into many other different systems or applications.

What is claimed is:

1. An image forming apparatus comprising:

a photoreceptor that moves in a process direction;

a sensor that senses a position of the photoreceptor in a cross-process direction that crosses the process direction, the position being sensed with respect to a reverence position;

a shifting mechanism that shifts the photoreceptor in the cross-process direction; and a controller that receives the sensed position from the sensor, compares the sensed position with a target position, and controls the shifting mechanism to shift the photoreceptor toward the target position, the target position varying over time with respect to the reference position.

2. The apparatus according to claim 1, wherein the sensor physically contacts the photoreceptor.

3. The apparatus according to claim 2, wherein the sensor contacts an edge of the photoreceptor.

4. The apparatus according to claim 1, wherein the sensor is an optical sensor.

5. The apparatus according to claim 1, wherein the shifting mechanism continuously shifts the photoreceptor.

6. The apparatus according to claim 1, wherein the target position continuously varies over time.

7. The apparatus according to claim 6, wherein the target position varies sinusoidally with respect to the reference position.

8. The apparatus according to claim 1, wherein the target position varies in steps.

9. The apparatus according to claim 1, wherein the target position varies based on a number of images formed over time on the photoreceptor.

10. The apparatus according to clam 1, wherein the photoreceptor includes a continuous belt.

11. The apparatus according to claim 10, wherein the reference position is normalized to account for non-uniformities in an edge of the photoreceptor.

12. The apparatus according to claim 1, wherein the apparatus is a xerographic imaging apparatus.

13. The apparatus according to claim 1, wherein the reference position is a constant position.

14. A method of controlling an image forming apparatus, the method comprising:

sensing, with a sensor, a position of a photoreceptor in a cross-process direction which crosses a process direction in which the photoreceptor moves, the position being sensed with respect to a reference position;

determining, with a controller, a shift amount by which to shift the photoreceptor in the cross-process direction, the shift amount being determined by comparing the sensed position with a target position, the target position varying over time with respect to the reference position; and shifting the photoreceptor in the cross-process direction by the determined shift amount.

15. The method according to claim 14, wherein the sensing senses an edge of the photoreceptor.

16. The method according to claim 14, wherein the photoreceptor is continuously shifted in the cross-process direction.

17. The method according to claim 14, wherein the reference position is normalized to account for non-uniformities in an edge of the photoreceptor.

18. The method according to claim 14, wherein the photoreceptor is shifted sinusoidally with respect to the reference position.

19. The method according to claim 14, wherein the photoreceptor is shifted in steps with respect to the reference position.

20. The method according to claim 14, wherein the target position continuously varies over time.

* * * * *